United States Patent [19]

Futaba et al.

[11] 4,257,118

[45] Mar. 17, 1981

[54] WATCH CASE

[75] Inventors: Kunihiko Futaba, Akishima; Toshikazu Shimazaki, Tokyo; Atsumi Osagawa, Machida; Akira Hiraoka, Tokorozawa, all of Japan

[73] Assignee: Citizen Watch Co., Ltd., Tokyo, Japan

[21] Appl. No.: 1,216

[22] Filed: Jan. 5, 1979

[30] Foreign Application Priority Data

Jan. 24, 1978 [JP] Japan ..... 53-7075[U]

[51] Int. Cl.[3] ..... G04B 37/00

[52] U.S. Cl. ..... 368/276

[58] Field of Search ..... 58/88 R; 368/276

[56] References Cited

U.S. PATENT DOCUMENTS

| | | | |
|---|---|---|---|
| 4,083,178 | 4/1978 | Sekiguchi et al. | 58/88 R |
| 4,103,483 | 8/1978 | Riley | 58/90 R |

*Primary Examiner*—J. V. Truhe
*Assistant Examiner*—John B. Conklin
*Attorney, Agent, or Firm*—Sherman & Shalloway

[57] ABSTRACT

A watch case including outer and inner bodies, a cover member and a flexible packing ring in which provision is made of a horizontal groove formed on the outside wall of the inner body, a spring having an internal side fitted to the horizontal groove, a vertical groove formed on the outside wall of the inner body into which a lever is inserted, a first hole provided on one side of the inside wall of the outer body with which one end of the spring is engaged, a second hole provided on opposite side of the inside wall of the outer body with which the other end of the spring is engaged, and the lever supporting the spring engaged with an elongate hole formed on the outer body, and thereby being easily assembled and disassembled by means of the lever.

5 Claims, 7 Drawing Figures

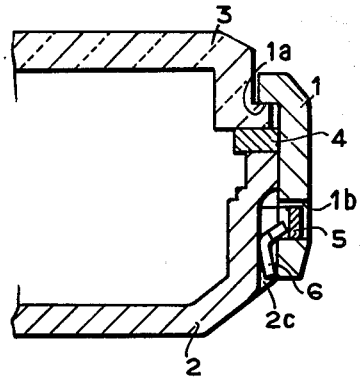
FIG. 1
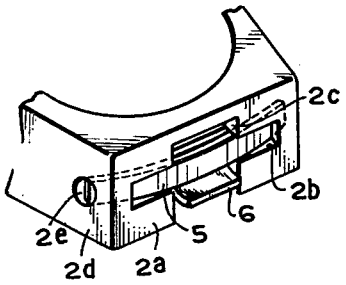
FIG. 2
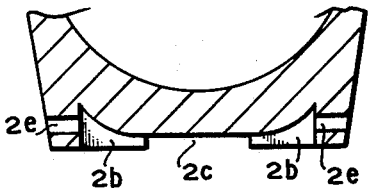
FIG. 3
FIG. 4
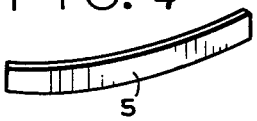
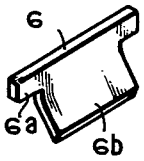
FIG. 5
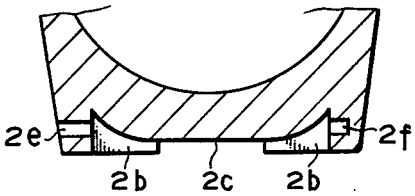
FIG. 6
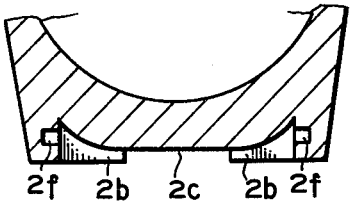
FIG. 7

WATCH CASE

BACKGROUND OF THE INVENTION

1. Field of the Invention

This invention relates to improvement of a waterproof watch case in which a cover member, an outer body and inner body are assembled and disassembled with ease by means of a lever member.

2. Description of the Prior Art

So far, in the so-called square-type waterproof timepieces, a portion of a leaf spring or a wire spring was fitted in a lateral groove formed in an inner body, and another portion was protruded to fasten the inner body to an outer body. In this case, however, the protruded portion had to be once depressed to permit fastening of the two, deteriorating the efficiency in the assembling operation.

SUMMARY OF THE INVENTION

This invention is to remove the abovementioned defect, and its object is to provide a watch case which permits an inner body and an outer body to be assembled and disassembled very easily while maintaining stable waterproof performance.

That is, in a conventional watch case construction, a leaf spring was fitted by caulking to a lateral groove of the inner body in such a manner that one or both end portions of the leaf spring were allowed to slide in the lateral groove but were not allowed to protrude beyond the inner body, and a lever member was inserted between the leaf spring and the groove, so that when the inner body was fitted to the outer body, the spring member was pushed up by the lever member and was allowed to engage with an elongated hole penetrating through the outer body to attain the fastening. According to the construction of this invention, however, the spring member is not fitted by caulking, and the inner body is made of a material which is not capable of fastening the spring member by caulking. Therefore, the resilient property of the spring is prevented from being deteriorated by the caulking, and the outer body and the inner body can be assembled and disassembled more reliably, and the spring can be incorporated more easily.

BRIEF DESCRIPTION OF THE DRAWINGS

FIG. 1 is a vertical cross-sectional view of a watch case assembled according to an embodiment of this invention;

FIG. 2 is a perspective view of FIG. 1;

FIG. 3 is a plan view showing a portion near the lateral groove in the inner body;

FIG. 4 is a perspective view of a spring member;

FIG. 5 is a perspective view of a resilient lever member; and

FIGS. 6 and 7 are plan views showing a portion near the lateral groove in the inner body according to other modified embodiments respectively.

DETAILED DESCRIPTION OF THE PREFERRED EMBODIMENT

FIG. 1 to FIG. 3 show a body of a square-type waterproof timepiece according to an embodiment of this invention, in which an inner body 2 made of resin and a cover member 3, e.g. glass are accommodated in an outer body 1 made of a metal such as stainless steel, and a resilient packing ring 4 is interposed between the upper surface of the inner body 2 and the lower surface of the timepiece glass 3. The cover member 3 may be a glass fitted to a glass ring. A lateral groove **2*b* of which the central portion is shallow and which deepens toward its both ends (refer to FIG. 3), and a vertical groove 2*c* which crosses the lateral groove 2*b* but which is not penetrating through up to the upper surface of the inner body 2, are formed in a side wall 2*a* of the inner body 2 with which will engage the outer body 1. Further, lateral holes 2*e* (refer to FIG. 3) penetrate through both side walls 2*d* starting from both ends of the lateral groove 2*b***.

A leaf spring 5 is so curved as to fit to the shape of the lateral groove **2*b*, supported and enclosed at both ends by the lateral holes 2*e*, and is accommodated in the lateral groove 2*b***.

A resilient lever member 6, as depicted in FIG. 5 engages with the lateral groove **2*b* to prevent the disengagement, and has arm portions 6*a* for pushing up the spring 5 and a leg portion 6*b* that will be inserted in the vertical groove 2*c*. The lever member 6 is inserted between the two grooves 2*b*, 2*c* and the spring 5. The outer body 1** having a flange l*a* for holding the cover member 3, has an elongated groove or hole **1*b* formed in a wall that faces the lateral groove 2*b* of the inner body 2. The elongated hole 1*b* is formed at a position where the spring 5 will so work as to compress the resilient packing ring 4 when the inner body 2 is engaged with the outer body 1**.

Below is mentioned the assembling of the inner body 2 and outer body 1. First, a mechanical assembly having a dial is accommodated in the inner body 2, the cover member 3 is placed on the upper surface of the inner body 2 via the resilient packing ring 4, and then the outer body 1 is fitted to the inner body 2. As the upper portion of the outer body 1 is depressed by hand, the inner wall at a lower portion of the outer body 1 pushes down the leg portion **6*b* of the lever member 6, and the arm portions 6*a* of the lever member 6 push up the spring 5, so as to be engaged with the elongated hole 1*b* of the outer body 1. Since the lever member 6 has a suitable degree of resiliency, the spring 5 and the elongated hole 1*b* of the outer 1** come into engagement with each other keeping very good timing.

To separate the outer 1 from the inner 2, the spring 5 should be pushed through the elongated hole **1*b* in the outer body 1** using a tool such as tweezers or a screw driver.

In FIGS. 6 and 7, there are shown other modified embodiments of this invention. FIG. 6 is a plan view showing a portion near the lateral groove in the inner body and corresponds to FIG. 3. In this embodiment, reference numeral **2*f* depicts a blind hole in lieu of one of the through holes 2*e* in FIG. 3. Further FIG. 7 shows still other modified embodiments in which privision is made of both blind holes 2*f* in lieu of both the through holes in FIG. 3**.

According to this invention mentioned above, the leaf spring is inserted through a lateral hole or into the blind holes without fastening it. Further, the leaf spring is not held by caulking but is enclosed and supported at its both ends by the lateral holes allowing it to move in the lateral groove. Consequently, the spring is allowed to freely move in the lateral groove, enabling the outer body and the inner body to be engaged or disengaged very easily. Moreover, a step for fastening the spring by caulking can be omitted. The spring is never removed from the lateral hole as the outer body is covered on the inner body. Even though the step of fastening the spring is omitted, the spring needs not be formed in a complicated shape but can be simply produced by the press working. Here, the inner body needs not necessarily be made of a non-metallic resin, but may be made of a metal by way of casting or melt forging.

What is claimed is:

1. A watch case comprising:

a. an outer body having an inside wall;

b. an inner body having an outside wall;

c. a cover member;

d. a flexible packing ring sandwiched between the upper surface of said inner body and the lower surface of said cover member;

e. a horizontal groove formed on the outside wall of said inner body;

f. a spring having an internal side fitted to said horizontal groove;

g. a vertical groove formed on the outside wall of said inner body into which a lever is inserted;

h. a first hole provided at one end of said horizontal groove within which one end of said spring is enclosed;

i. a second hole provided at the opposite end of said horizontal groove within which the other end of said spring is enclosed; and j. said lever supporting said spring in engagement with an elongate groove formed on said outer body, wherein said first and second holes are enclosed openings formed in the inner body, the holes permitting the spring to be inserted therein during assembly.

2. A watch case as claimed in claim 1 wherein at least one of said first and said second holes is a through hole.

3. A watch case as claimed in claim 1 wherein at least one of said first and said second holes is a blind hole.

4. A watch case as claimed in claim 1 wherein said inner body is made of resin.

5. A watch case as claimed in claim 1 wherein said spring is a leaf spring.

* * * * *